US008248357B2

(12) United States Patent
Park et al.

(10) Patent No.: US 8,248,357 B2
(45) Date of Patent: Aug. 21, 2012

(54) PIXEL DRIVING CIRCUIT AND A DISPLAY DEVICE HAVING THE SAME

(75) Inventors: Sang-Jin Park, Yongin-si (KR); Young-Ok Cha, Gwangmyung-si (KR); Joo-Hyung Lee, Gwacheon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 905 days.

(21) Appl. No.: 12/347,225

(22) Filed: Dec. 31, 2008

(65) Prior Publication Data

US 2009/0174692 A1 Jul. 9, 2009

(30) Foreign Application Priority Data

Jan. 4, 2008 (KR) ..... 10-2008-0001398

(51) Int. Cl.
*G09G 3/36* (2006.01)

(52) U.S. Cl. ..... 345/100; 345/98

(58) Field of Classification Search ..... 345/87, 345/98–100, 204; 377/64
See application file for complete search history.

(56) References Cited

U.S. PATENT DOCUMENTS

| | | | | |
|---|---|---|---|---|
| 2004/0217935 | A1* | 11/2004 | Jeon et al. | 345/100 |
| 2006/0056267 | A1* | 3/2006 | Kim et al. | 365/233 |
| 2006/0238482 | A1* | 10/2006 | Jang et al. | 345/100 |
| 2007/0052658 | A1* | 3/2007 | Kim | 345/100 |

FOREIGN PATENT DOCUMENTS

| | | |
|---|---|---|
| JP | 2005037849 | 2/2005 |
| JP | 2007078717 | 3/2007 |
| KR | 1020040061680 | 7/2004 |

* cited by examiner

*Primary Examiner* — Regina Liang
(74) *Attorney, Agent, or Firm* — F. Chau & Associates, LLC

(57) ABSTRACT

A pixel driving circuit includes a first driver and a second driver. The first gate driver includes a plurality of stage units connected to odd-numbered gate lines. The second gate driver includes a plurality of stage units connected to even-numbered gate lines. Each of the stage units of the first and second gate drivers includes an input unit, a first signal output unit, and a second signal output unit. The input unit outputs a driving control signal according to a previous stage driving signal output from the previous stage unit and a next stage driving signal output from the next stage unit. The first signal output unit outputs a stage driving signal according to the driving control signal and a driving clock signal. The second signal output unit outputs a gate voltage signal to the corresponding gate line according to the driving control signal and a gate clock signal.

25 Claims, 10 Drawing Sheets

PIXEL DRIVING CIRCUIT AND A DISPLAY DEVICE HAVING THE SAME

CROSS-REFERENCE TO RELATED APPLICATION

This application claims priority to Korean Patent Application No. 10-2008-0001398, filed on Jan. 4, 2008, under 35 U.S.C. §119, the contents of which are incorporated by reference in their entirety herein.

BACKGROUND

1. Technical Field

The present disclosure relates to a pixel driving circuit and a display device having the same, and more particularly, to a pixel driving circuit and a display device having the same, with a varying scan direction.

2. Discussion of Related Art

Display devices can display an image by providing image signals to a plurality of pixels. A liquid crystal display (LCD) device displays a desired image by changing the light transmittance of liquid crystal for each pixel. Such a display device includes: a display panel having a plurality of pixels; and gate/data drivers controlling the operations of the pixels. The gate driver provides a gate turn-on voltage (e.g., a scan signal) sequentially to a plurality of gate lines connected to the pixels. The data driver provides a data signal to a plurality of data lines connected to the pixels. Thus, the pixels receiving the gate turn-on voltage are enabled, and the data signal is provided to the enabled pixels to display a desired image.

In a conventional design, a gate driver is fabricated in an IC configuration and the fabricated gate driver is mounted on a display panel. However, a sufficient mounting space is needed to mount the gate driver. Another conventional design integrates the gate driver into the display panel to reduce the size of the display panel. The gate driver is fabricated simultaneously with the pixel elements. The gate driver includes a plurality of stage units corresponding respectively to a plurality of gate lines. In order to provide a gate turn-on voltage to the gate lines sequentially through the stage units, each of the stage units uses an output signal of a previous stage unit as an enable signal.

It is desirable to be able to display smooth images even when a display panel is rotated freely. When a gate turn-on voltage is provided to gate lines sequentially through stage units, the applying direction of the gate turn-on voltage is changed by rotation of a display panel. For example, when the display panel is rotated by 180°, the direction of the gate turn-on voltage, which was provided sequentially from top to bottom of the non-rotated display panel, is inverted. The direction is inverted because each of the stage units is enabled by the next stage unit due to the 180° rotation of the display panel. A gate turn-on voltage may be applied to provide a signal corresponding to a desired gradation of a pixel and then a separate boosting voltage can be provided to change the gradation of the pixel. However, when the display panel is then rotated by 180°, the boosting voltage is provided before application of the gate turn-on voltage, thus losing the benefit of the boosting voltage.

SUMMARY

In accordance with an exemplary embodiment of the present invention, a pixel driving circuit includes: a first gate driver and a second gate driver. The first gate driver includes a plurality of stage units connected respectively to odd-numbered gate lines of a plurality of gate lines. The second gate driver includes a plurality of stage units connected respectively to the even-numbered gate lines of the plurality of gate lines. Each of the stage units of the first and second gate drivers include: an input unit, a first signal output unit, and a second signal output unit. The input unit is configured to output a driving control signal according to a previous stage driving signal output from the previous stage unit and a next stage driving signal output from the next stage unit. The first signal output unit is configured to output a stage driving signal according to the driving control signal and a driving clock signal. The second signal output unit is configured to output a gate voltage signal to the corresponding gate line according to the driving control signal and a gate clock signal.

The input unit may include: a first switch and a second switch. The first switch is configured to connect a driving control signal output terminal and a forward direction signal input terminal receiving a forward direction signal according to a stage driving signal of a previous stage unit. The second switch is configured to connect the driving control signal output terminal and a backward direction signal input terminal receiving a backward direction signal with a logic level opposite to the logic level of the forward direction signal according to a stage driving signal of the next stage unit.

Each of the stage units may further include a reset unit configured to generate a reset control signal according to the driving control signal and the driving clock signal. The driving control signal, the stage driving signal, and the gate voltage signal may transition to a logic-low level according to the reset control signal.

The reset unit may include: a third switch, a fourth switch, and a first capacitor. The third switch is configured to reduce the logic level of the driving control signal to a ground level according to the reset control signal. The fourth switch is configured to electrically connect a reset control signal output terminal and a ground signal input terminal according to the driving control signal. The first capacitor is connected between the driving clock signal input terminal and the reset control signal output terminal.

The first signal output unit may output the stage driving signal at a high logic level when the driving control signal at a high logic level and the driving clock signal are applied. The second signal output unit may output the gate voltage signal at a high logic level when the driving control signal at a high logic level and the gate clock signal are applied. A logic-high period of the driving clock signal may be repeated periodically for a 1-frame period. A logic-high period of the gate clock signal may be repeated periodically for a 1-frame period or for at least a part of the 1-frame period.

The first signal output unit may include: a fifth switch, a second capacitor, a sixth switch, and a seventh switch. The fifth switch is configured to output the driving clock signal as the stage driving signal according to the driving control signal. The second capacitor is connected between a stage driving signal output terminal and a driving control signal input terminal. The sixth switch is configured to output the ground level as the stage driving signal according to the reset control signal. The seventh switch is configured to output the ground level as the stage driving signal according to the driving clock signal.

The second signal output unit may include: an eighth switch, a third capacitor, a ninth switch, and a tenth switch. The eighth switch is configured to output the gate clock signal as the gate voltage signal according to the driving control signal. The third capacitor is connected between a gate voltage signal output terminal and a driving control signal input terminal. The ninth switch is configured to output the ground level as the gate voltage signal according to the reset control signal. The tenth switch is configured to output the ground level as the gate voltage signal according to the driving clock signal.

The gate lines may be connected to a plurality of pixels. Each of the stage units may further include a boosting voltage provider configured to provide a boosting voltage to the pixels connected to the corresponding gate line according to the driving control signal after the gate voltage signal is provided to the corresponding gate line at a high logic level.

The boosting voltage provider may include: an eleventh, twelfth, thirteenth, fourteenth, and fifteen switches. The eleventh switch is configured to provide the boosting voltage to a pixel of the plurality according to the driving control signal. The twelfth switch is configured to provide a first-level common voltage to the pixel according to a first control voltage. The thirteenth switch is configured to provide a second-level common voltage to the pixel according to a second control voltage. The fourteenth switch is configured to provide the first control voltage to the twelfth switch according to the driving control signal. The fifteenth switch is configured to provide the second control voltage to the thirteenth switch according to the driving control signal.

The driving clock signal may include: a first driving clock signal, a first driving clock bar signal, a second driving clock signal, and a second driving clock bar signal. The first driving clock signal and the first driving clock bar signal are provided to the stage units in one of the first and second gate drivers. The second driving clock signal and the second driving clock bar signal are provided to the stage units in the other of the first and second gate drivers.

The first and second driving clock signals may have a cycle of four periods (4H). The first and second driving clock signals may have a logic-high for two periods (2H) of one cycle. The first and second driving clock signals may have a phase difference of one period (1H) therebetween. The first driving clock bar signal may be an inverted signal of the first driving clock signal. The second driving clock bar signal may be an inverted signal of the second driving clock signal.

The gate clock signal may include: a first gate clock signal and a second gate clock signal. The first gate clock signal and the first gate clock bar signal are alternately provided to the stage units in one of the first and second gate drivers. The second gate clock signal and a second gate clock bar signal are alternately provided to the stage units in the other of the first and second gate drivers.

The first gate clock signal, the first gate clock bar signal, the second gate clock signal, and the second gate clock bar signal may have a cycle of four periods (4H). The first gate clock signal, the first gate clock bar signal, the second gate clock signal, and the second gate clock bar signal may be a logic-high for one period (1H) of one cycle. The first gate clock signal may have the same rising-edge period as the first driving clock signal. The first gate clock bar signal may have the same rising-edge period as the first driving clock bar signal. The second gate clock signal may have the same rising-edge period as the second driving clock signal. The second gate clock bar signal may have the same rising-edge period as the second driving clock bar signal.

In accordance with another exemplary embodiment of the present invention, a display device includes: a display panel, a signal controller, a first gate driver, and a second gate driver. The display panel includes a plurality of gate lines and a plurality of pixels connected to the gate lines. The signal controller is configured to provide a driving clock signal and a gate clock signal. The first gate driver includes a plurality of odd stage units connected to the odd-numbered gate lines. Each of the odd stage units are configured to provide an odd stage driving signal to the previous/next stage unit according to the driving clock signal and a previous/next odd stage driving signal output from the previous/next stage unit and to provide a gate voltage signal to the corresponding odd-numbered gate line according to the gate clock signal and the previous/next odd stage driving signal. The second gate driver includes a plurality of even stage units connected to the even-numbered gate lines. Each of the even stage units are configured to provide an even stage driving signal to the previous/next stage unit according to the driving clock signal and a previous/next even stage driving signal output from the previous/next stage unit and to provide a gate voltage signal to the corresponding even-numbered gate line according to the gate clock signal and the previous/next even stage driving signal.

Each of the odd stage units and the even stage units may include: an input unit, a first signal output unit, and a second signal output unit. The input unit is configured to output a driving control signal according to an output signal of the previous/next stage unit. The first signal output unit is configured to output the odd or even stage driving signal according to the driving control signal and the driving clock signal and to change the voltage level of the driving control signal. The second signal output unit is configured to output the gate voltage signal to the corresponding gate line according to the driving control signal and the gate clock signal and to change the voltage level of the driving control signal.

The first signal output unit may perform one of a forward sequential driving operation and a backward sequential driving operation for a 1-frame period according to the order of the gate line connected to the stage unit. The second signal output unit may perform one of a forward sequential driving operation and a backward sequential driving operation for a 1-frame period or for a part of the 1-frame period according to the order of the gate line connected to the stage unit.

Each pixel may include a pixel capacitor and a storage capacitor configured to maintain the charge quantity of the pixel capacitor. Each of the stage units may further include a boosting voltage provider configured to provide a boosting voltage to the storage capacitor according to the voltage level of the driving control signal.

The driving clock bar signal may include a first driving clock signal, a first driving clock bar signal, a second driving clock signal and a second driving clock bar signal. The first driving clock signal and the first driving clock bar signal are provided to the odd stage units. The second driving clock signal and the second driving clock bar signal are provided to the even stage units. The first and second driving clock signals may have a cycle of four periods (4H) and a logic-high for two periods (2H) one of the cycle. The first and second driving clock signals may have a phase difference of one period (1H) therebetween. The first driving clock bar signal may be an inverted signal of the first driving clock signal. The second driving clock bar signal may be an inverted signal of the second driving clock signal.

The gate clock signal may include a first gate clock signal and a first gate clock bar signal that are alternately provided to the odd stage units and a second gate clock signal and a second gate clock bar signal that are alternately provided to the odd stage units. The first gate clock signal, the first gate clock bar signal, the second gate clock signal, and the second gate clock bar signal may have a cycle of four periods (4H). The first gate clock signal, the first gate clock bar signal, the second gate clock signal, and the second gate clock bar signal may have a logic-high for one period (1H) of one cycle. The first gate clock signal may have the same rising-edge period as the first driving clock signal, the first gate clock bar signal may have the same rising-edge period as the first driving clock bar signal, the second gate clock signal may have the same rising-edge period as the second driving clock signal, and the second gate clock bar signal may have the same rising-edge period as the second driving clock bar signal.

The display panel may further include a display region provided with the pixels and a peripheral region provided around the display region The first and second gate drivers may be disposed on both side edges of the peripheral region.

In accordance with an exemplary embodiment of the present invention, a pixel driving circuit includes: an input unit, a first signal output unit, and a second signal output unit. The input unit is configured to output a driving control signal according to a $(Pn-2)^{th}$ stage driving signal output from the $(Pn-2)^{th}$ previous stage unit and a $(Pn+2)^{th}$ stage driving signal output from the $(Pn+2)^{th}$ stage unit. The first signal output unit is configured to output a stage driving signal according to the driving control signal and a driving clock signal and to change the voltage level of the driving control signal. The second signal output unit is configured to output a gate voltage signal to the corresponding gate line according to the driving control signal and a gate clock signal and to change the voltage level of the driving control signal.

The gate line may be connected to at least one of a plurality of pixels. The pixel driving circuit may further include a boosting voltage provider configured to provide a boosting voltage to the pixels connected to the corresponding gate line according to the driving control signal after the gate voltage signal of a high logic level is provided to the corresponding gate line.

In accordance with an exemplary embodiment of the present invention, a method of driving a pixel driving circuit includes: generating a logic-high driving control signal according to one of a $(Pn-2)^{th}$ stage driving signal and a $(Pn+2)^{th}$ stage driving signal; applying a logic-high driving clock signal to generate a logic-high stage driving signal and to increase the voltage level of the driving control signal; applying a logic-high gate clock signal to apply a logic-high gate voltage signal to a corresponding gate line and to increase the voltage level of the driving control signal; applying a logic-low gate clock signal to apply a logic-low gate voltage signal to the corresponding gate line and to reduce the voltage level of the driving control signal; applying a logic-low driving clock signal to generate a logic-low stage driving signal and to reduce the voltage level of the driving control signal; and generating a logic-low driving control signal according to the other of the $(Pn-2)^{th}$ stage driving signal and the $(Pn+2)^{th}$ stage driving signal.

The method may further include providing a boosting voltage to a plurality of pixels connected to the gate line after the applying of the logic-low gate voltage signal to the corresponding gate line.

The driving control signal may maintain a logic-high level for four periods (4H). The logic-high gate voltage signal may be applied to the corresponding gate line for at least one of three periods (3H) of the four periods (4H), except the last period of the four periods (4H). The boosting voltage may be provided for the last period.

BRIEF DESCRIPTION OF THE DRAWINGS

Exemplary embodiments can be understood in more detail from the following description taken in conjunction with the accompanying drawings, in which.

DETAILED DESCRIPTION OF EXEMPLARY EMBODIMENTS

Hereinafter, exemplary embodiments of the present invention will be described in further detail with reference to the accompanying drawings.

Figure 1:
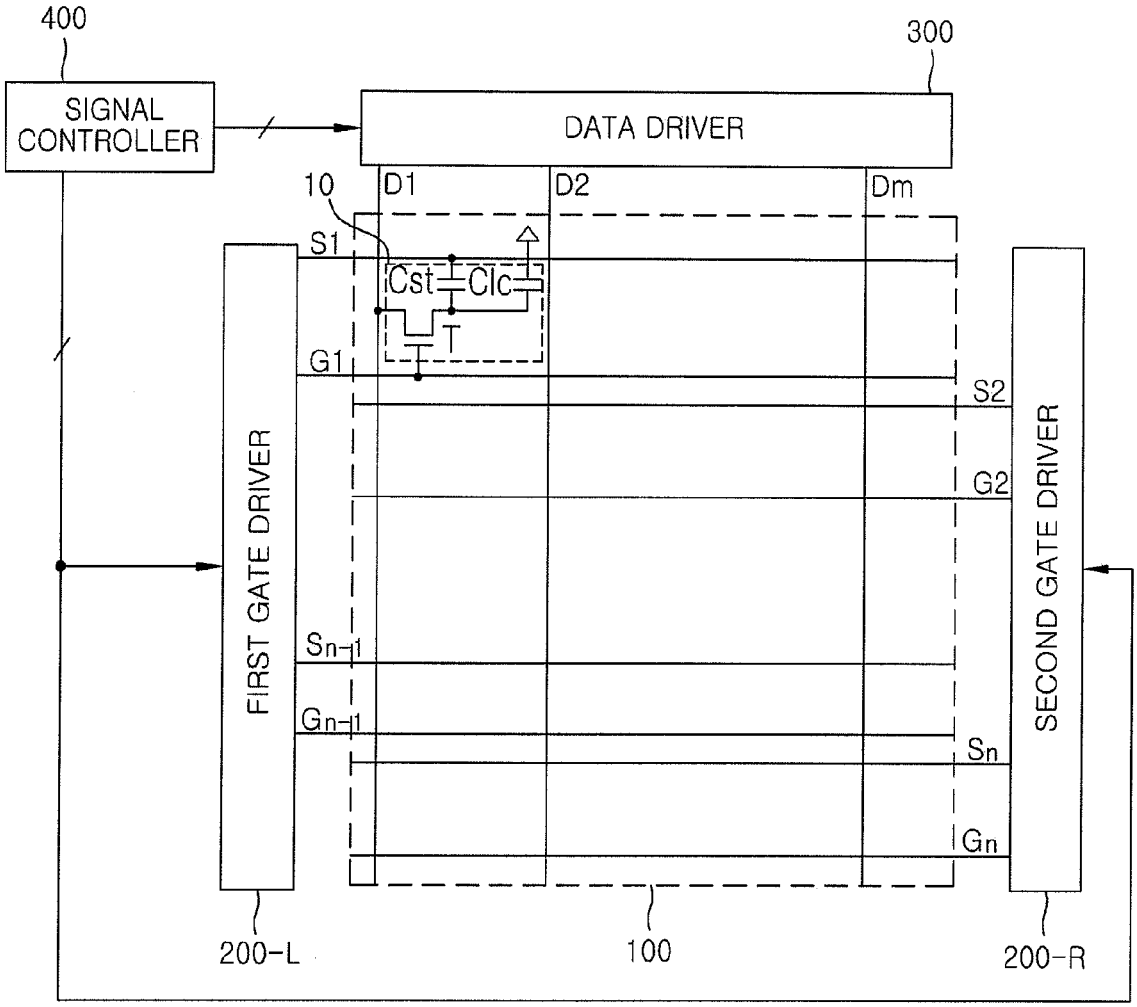
FIG. 1 is a block diagram of a display device according to an exemplary embodiment of the present invention.
Figure 2:
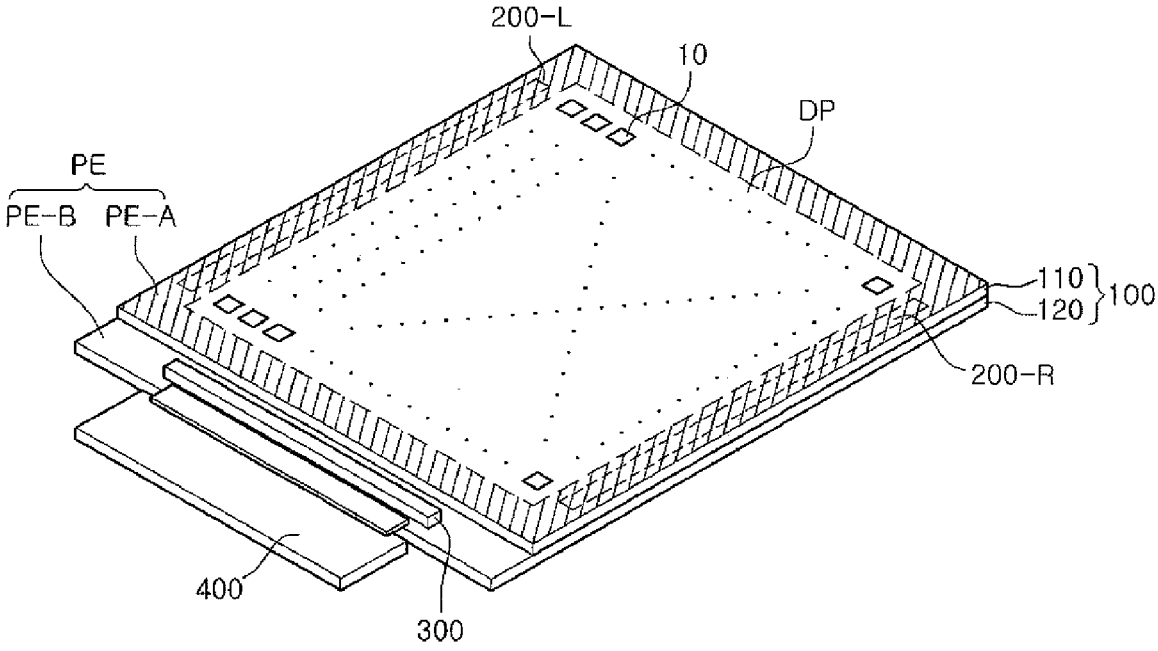
FIG. 2 is a perspective view of the display device according to an exemplary embodiment.
Figure 3:
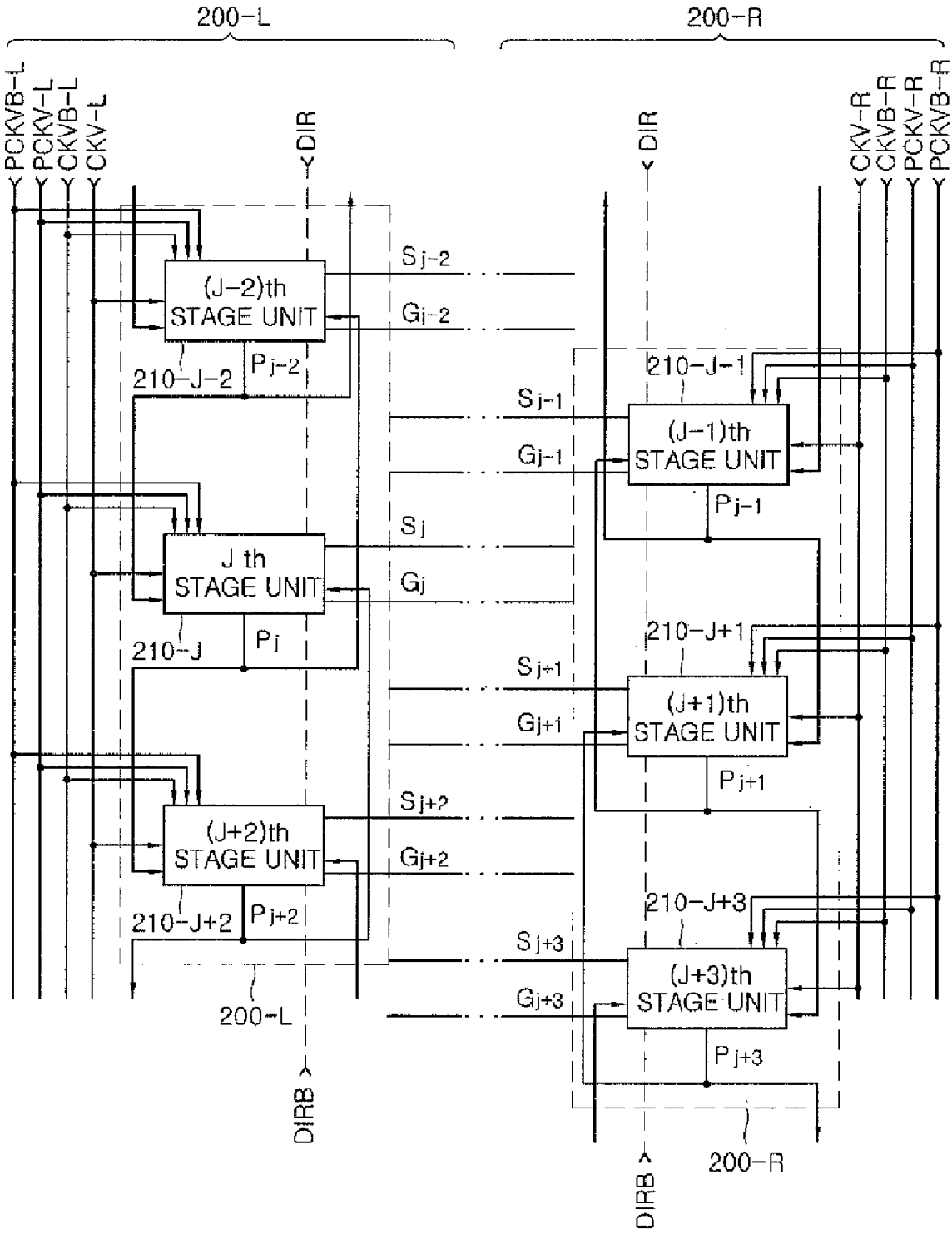
FIG. 3 is a block diagram of first and second gate drivers according to an exemplary embodiment of the present invention.
Figure 4:
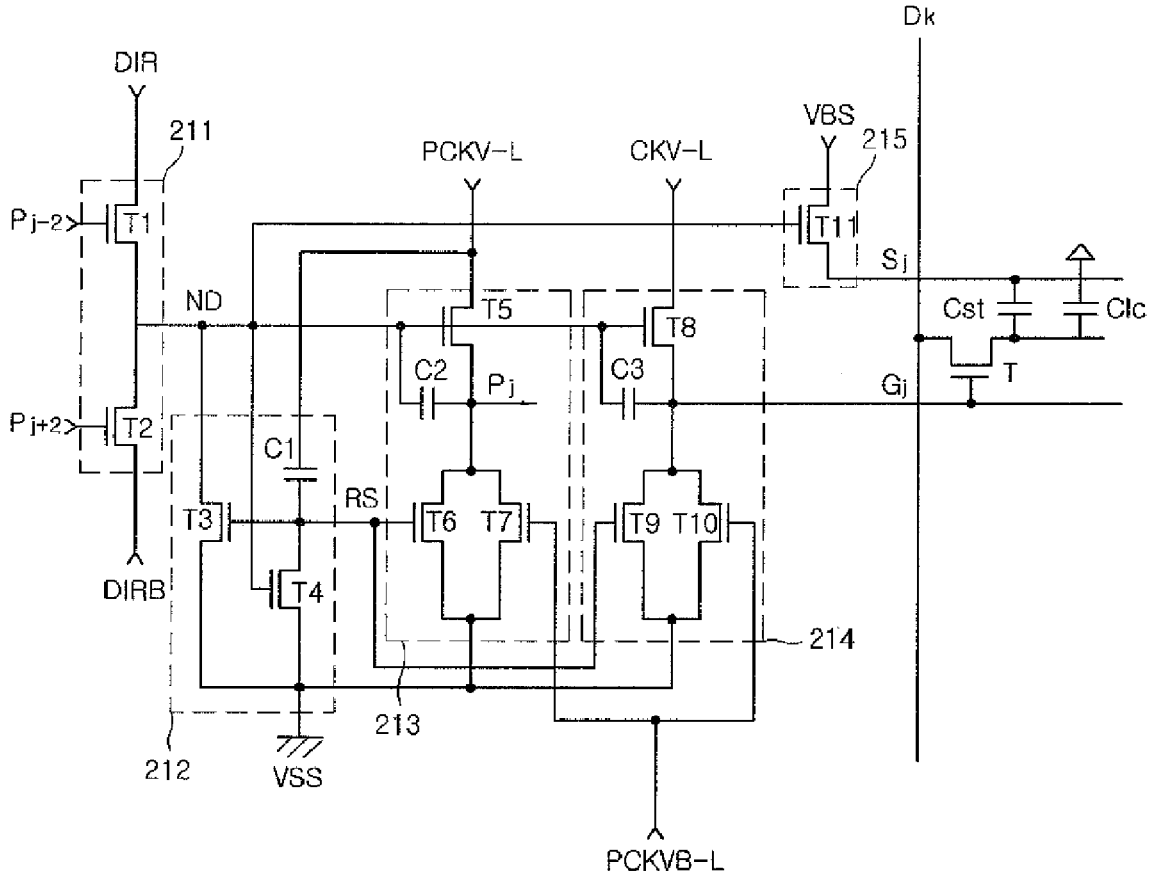
FIG. 4 is a circuit diagram of a stage unit according to an exemplary embodiment of the present invention.

FIG. 1 is a block diagram of a display device according to an exemplary embodiment of the present invention. FIG. 2 is a perspective view of the display device according to an exemplary embodiment of the present invention. FIG. 3 is a block diagram of first and second gate drivers according to an exemplary embodiment of the present invention. FIG. 4 is a circuit diagram of a stage unit according to an exemplary embodiment of the present invention.

Referring to FIGS. 1 through 4, a display device includes a display panel 100, first and second gate drivers 200-L and 200-R, a data driver 300, and a signal controller 400.

As illustrated in FIG. 1, the display panel 100 includes a plurality of gate lines G1 through Gn extending in one direction, and a plurality of data lines D1 through Dm extending in a direction intersecting the gate lines G1 through Gn. The display panel 100 includes a plurality of pixels 10 connected to the gate lines G1 through Gn and the data lines D1 through Dm. Each of the pixels 10 includes a thin film transistor T and a pixel capacitor Clc. Each of the pixels 10 may further include a storage capacitor Cst. Each of the pixels 10 displays a color of red (R), green (C), or blue (B). The display panel 100 further includes a plurality of storage lines S1 through Sn connected to the storage capacitors Cst.

As illustrated in FIG. 2, the display panel 100 includes a transparent upper substrate 110 and a lower substrate 120. The lower substrate 120 includes thin film transistors T, gate lines G1 through Gn, data lines D1 through Dm, pixel electrodes for pixel capacitors Clc, and storage electrodes for storage capacitors Cst. The upper substrate 110 includes a light shielding pattern (e.g., a black matrix), a color filter, and a common electrode for the pixel capacitors Clc. A liquid crystal layer is interposed between the lower substrate 120 and the upper substrate 110. Each of the thin film transistors T has a gate connected to the corresponding gate line, a source connected to the corresponding data line, and a drain connected to the corresponding pixel electrode. The thin film transistors T are turned on according to a gate turn-on signal, which is applied to the corresponding gate line, to supply a data signal (i.e., a gradation signal) of the corresponding data line to the corresponding pixel electrode, thereby changing an electric field between both terminals of the corresponding pixel capacitor Clc. An arrangement of the liquid crystals in the display panel 100 is changed to control the transmittance of light supplied from a backlight unit. The pixel electrode may include a plurality of slit and/or protrusion patterns as a domain control unit for controlling the arrangement direction of the liquid crystal. The common electrode may include a protrusion and/or slit pattern. The liquid crystals may be aligned in a vertical alignment mode. However, the present invention is not limited to a vertical alignment mode. For example, the liquid crystals may be aligned in a variety of other alignment modes depending on the type of liquid crystals.

A control unit, which includes the first and second gate drivers 200-L and 200-R, the data driver 300, and the signal controller 400, may be provided external to the display panel 100. The control unit supplies driving signals to the display panel 100, which enables the display panel 100 to display an image by receiving an external light. The components of the control unit may be fabricated in a single IC chip and electrically connected to the display panel 100. Alternately, each of the components of the control unit may be fabricated in different chips, or some of the components may be integrated in the same chip. Further, some of the components may be fabricated simultaneously with the display panel 100. In one embodiment of the present invention, the first and second gate drivers 200-L and 200-R are integrated in the lower substrate 120 of the display panel 100. For example, the upper substrate 110 and the lower substrate 120 can be divided into a display region DP and a peripheral region PE as illustrated in FIG. 2. The pixels 10 of the display panel 100 may be arranged in a matrix configuration in the display region DP of the upper and lower substrates 110 and 120. The first and second gate drivers 200-L and 200-R and the data driver 300 are disposed in the peripheral region PE, and the signal controller 400 is connected to the peripheral region PE.

The peripheral region PE includes an overlapping region PE-A where the upper substrate 110 and the lower substrate 120 overlap each other, and a protruding region PE-B where the lower substrate 120 protrudes. The first and second gate drivers 200-L and 200-R are disposed in the overlapping region PE-A. The circuit components of the first and second gate drivers 200-L and 200-R may be fabricated simultaneously with the thin film transistors T of the display panel 100. The first gate driver 200-L is disposed at the left side of the display region DP, and the second gate driver 200-R is disposed at the right side of the display region DP. The first gate driver 200-L is connected to the odd-numbered gate lines, and the second gate driver 200-R is connected to the even-numbered gate lines. As illustrated in FIG. 2, the data driver 300 may be mounted on the protruding region PE-B of the peripheral region PE. A printed circuit board mounting the signal controller 400 may be electrically connected to the protruding region PE-B. Although not illustrated, the printed circuit board may be mounted with a driving voltage generator that generates a plurality of driving voltages for driving the data driver 300, the signal controller 400, and the display panel 100.

The signal controller 400 generates pixel data by processing R/G/B image signals from an external graphic controller (not illustrated) in accordance with the operating condition of the display panel 100. The signal controller 400 generates a plurality of control signals including a gate control signal and a data control signal. The signal controller 400 transmits gate control signals to the first and second gate drivers 200-L and 200-R. The signal controller 400 provides pixel data and data control signals to the data driver 300. The gate control signals include a vertical sync start signal STV, first and second driving clock signals PCKV-L and PCKV-R, first and second driving clock bar signals PCKVB-L and PCKVB-R, first and second gate clock signals CKV-L and CKV-R, first and second gate clock bar signals CKVB-L and CKVB-R, a forward direction signal DIR, and a backward direction signal DIRB. The waveforms of the first and second gate clock signals CKV-L and CKV-R and the first and second gate clock bar signals CKVB-L and CKVB-R may be adjusted to locally drive the first and second gate drivers 200-L and 200-R. Thus, an image of the display panel 100 can be locally changed. The data control signals include a horizontal sync start signal, a load signal, and a data clock signal. The data control signals may further include an inverting signal for inverting the polarity of a gradation voltage with respect to a common voltage.

The data driver 300 generates and applies data signals (e.g., gradation signals) to the corresponding data lines D1 through Dm. For example, the data driver 300 is driven according to a data control signal to convert input digital pixel data into an analog data signal. Thereafter, the data driver 300 supplies the resulting data signal to the data lines D1 through Dm.

The first and second gate drivers 200-L and 200-R are driven by the vertical sync start signal STV to provide a gate turn-on voltage signal to the gate lines G1 through Gn sequentially and to provide a boosting voltage VBS to the storage lines S1 through Sn.

The first gate driver 200-L includes a plurality of stage units 210-J-2, 210-J and 210-J+2, and the second gate driver 200-R includes a plurality of stage units 210-J−1, 210-J+1 and 210-J+3. The stage units 210-J−2, 210-J and 210-J+2 of the first gate driver 200-L are connected to the odd-numbered gate lines, while the stage units 210-J−1, 210-J+1 and 210-J+3 of the second gate driver 200-R are connected to the even-numbered gate lines, or vice versa. The first and second gate drivers 200-L and 200-R may be driven sequentially. The first gate driver 200-L is connected to the odd-numbered gate lines, and the second gate driver 200-R is connected to the even-numbered gate lines. To provide the gate turn-on voltage signal to the gate lines G1 through Gn sequentially, it is preferable that the stage units 210-J−2, 210-J and 210-J+2 of the first gate driver 200-L and the stage units 210-J−1, 210-J+1 and 210-J+3 of the second gate driver 200-R be driven sequentially. For example, the gate turn-on voltage signal may be applied to the $J^{th}$ gate line $G_j$ through the $J^{th}$ stage unit 210-J of the first gate driver 200-L and then the gate turn-on voltage signal may be applied to the $(J+1)^{th}$ gate line $G_{j+1}$ through the $(J+1)^{th}$ stage unit 210-J+1 of the second gate driver 200-R.

The stage units 210 of the first and second gate drivers 200-L and 200-R respectively output stage driving signals $P_{j-2}$, $P_{j-1}$, $P_j$, $P_{j+1}$, $P_{j+2}$ and $P_{j+3}$ according to the first and second driving clock signals PCKV-L and PCKV-R and the first and second driving clock bar signals PCKVB-L and PCKVB-R. Each of the stage units 210 is enabled according to the previous and next stage driving signals $P_{j-2}$, $P_{j-1}$, $P_j$, $P_{j+1}$, $P_{j+2}$ and $P_{j+3}$, the forward direction signal DIR, and the backward direction signal DIRB. The stage units 210 provide the gate turn-on voltage signal to the corresponding gate lines G1 through Gn according to the first and second gate clock signals CKV-L and CKV-R and the first and second gate clock bar signals CKVB-L and CKVB-R. The stage units 210 provide the boosting voltage VBS to the corresponding storage lines S1 through Sn according to node signals thereof For example, as illustrated in FIG. 3, the $J^{th}$ stage unit 210-J is driven according to direction signals (e.g., the forward direction signal DIR and the backward direction signal DIRB), the $(J-2)^{th}$ stage driving signal $P_{j-2}$ of the $(J-2)^{th}$ stage unit 210-J−2, and the $(J+2)^{th}$ stage driving signal $P_{j+2}$ of the $(J+2)^{th}$ stage unit 210-J+2. The $J^{th}$ stage unit 210-J generates the $J^{th}$ stage driving signal $P_j$ according to the first driving clock signal PCKV-L, the first driving clock bar signal PCKVB-L, the first gate clock signal CKV-L, and the first gate clock bar signal CKVB-L, provides the gate turn-on voltage signal to the $j^{th}$ gate line $G_j$, and then provides the boosting voltage VBS to the $j^{th}$ storage line $S_j$.

Each of the stage units of the first and second gate drivers 200-L and 200-R enables or disables the adjacent upper and lower stage units 210 using the stage driving signals $P_{j-2}$, $P_{j-1}$, $P_j$, $P_{j+1}$, $P_{j+2}$ and $P_{j+3}$, the forward direction signal DIR, and the backward direction signal DIRB. Thus, the gate turn-on voltage signal can be provided sequentially from the top of the display panel 100 even when the display panel 100 is rotated by 180°. Each of the enabled stage units 210 provides the gate turn-on voltage signal to the corresponding gate line according to the first and second gate clock signals CKV-L and CKV-R and the first and second gate clock bar signals CKVB-L and CKVB-R. Thus, the first and second gate clock signals CKV-L and CKV-R and the first and second gate clock bar signals CKVB-L and CKVB-R may be adjusted to control the gate lines G1 through Gn receiving the gate turn-on voltage signal. For example, the gate turn-on voltage signal may be provided to some of the gate lines G1 through Gn and not provided to others of the gate lines G1 through Gn. The first or last stage unit of each of the first and second gate drivers 200-L and 200-R may be driven according to the vertical sync start signal. Each of the stage units 210 of the first gate driver 200-L receives the first gate clock signal CKV-L and the first gate clock bar signal CKVB-L alternately. For example, the first gate clock signal CKV-L is applied to the odd-numbered stage units of the first gate driver 200-L and the first gate clock bar signal CKVB-L is applied to the even-numbered stage units of the first gate driver 200-L. Each of the stage units 210 of the second gate driver 200-R receives the second gate clock signal CKV-R and the second gate clock bar signal CKVB-R alternately.

As illustrated in FIG. 4, each of the stage units 210 includes an input unit 211, a reset unit 212, first and second signal output units 213 and 214, and a boosting voltage provider 215. The following description is made in terms of the $J^{th}$ stage unit 210-J that is driven in a forward direction.

The input unit 211 outputs the forward direction signal DIR or the backward direction signal DIRB as a driving control signal according to the $(J-2)^{th}$ stage driving signal $P_{j-2}$ output from the previous stage unit (e.g., the $(J-2)^{th}$ stage unit 210-J-2) or the $(J+2)^{th}$ stage driving signal $P_{j+2}$ output from the next stage unit (i.e., the $(J+2)^{th}$ stage unit 210-J+2). For example, during a forward driving mode (i.e., when the first through $n^{th}$ stage units are driven sequentially), the input unit 211 outputs the forward direction signal DIR as a logic-high driving control signal according to the $(J-2)^{th}$ stage driving signal $P_{j-2}$ output from the previous stage unit. During the forward driving mode, the forward direction signal DIR is logically high and the backward direction signal DIRB is logically low. Thus, during the forward driving mode, the input unit 211 outputs the backward direction signal DIRB as a logic-low driving control signal when the $(J+2)^{th}$ stage driving signal $P_{j+2}$ output from the next stage unit is applied thereto. For example, during the backward driving mode (i.e., when the $n^{th}$ through first stage units are driven sequentially), the input unit 211 outputs the backward direction signal DIRB as a logic-high driving control signal according to the $(J+2)^{th}$ stage driving signal $P_{j+2}$ output from the next stage unit. During the backward driving mode, the input unit 211 outputs the forward direction signal DIR as a logic-low driving control signal when the $(J-2)^{th}$ stage driving signal $P_{j-2}$ output from the previous stage unit is applied thereto. During the backward driving mode, the forward direction signal DIR is logically low and the backward direction signal DIRB is logically high.

As illustrated in FIG. 4, the input unit 211 includes: a first and a second switch. The first switch is for connecting a forward direction signal (DIR) input terminal and a driving control signal (ND) output terminal according to the $(J-2)^{th}$ stage driving signal $P_{j-2}$. The second switch is for connecting a backward direction signal (DIRB) input terminal and the driving control signal (ND) output terminal according to the $(J+2)^{th}$ stage driving signal $P_{j+2}$. The first and second switches may be embodied respectively as first and second thin film transistors T1 and T2. For example, the first thin film transistor T1 has a gate connected to an input terminal of the $(J-2)^{th}$ stage driving signal $P_{j-2}$ output from the previous stage unit, a source connected to the forward direction signal (DIR) input terminal, and a drain connected to the driving control signal (ND) output terminal. The second thin film transistor T2 has a gate connected to an input terminal of the $(J+2)^{th}$ stage driving signal $P_{j+2}$ output from the next stage unit, a source connected to the backward direction signal (DIRB) input terminal, and a drain connected to the driving control signal (ND) output terminal.

The reset unit 212 outputs a reset control signal RS using the driving control signal ND, the first driving clock signal PCKV-L, and a logic-low ground signal VSS, and reduces the logic level of the driving control signal ND to a ground level.

The reset unit 212 includes: a third switch, a fourth switch, and a first capacitor C1. The third switch is configured to reduce the logic level of the driving control signal ND to the ground level according to the reset control signal RS. The fourth switch is configured to connect a reset control signal (RS) output terminal and a ground signal (VSS) input terminal according to the driving control signal ND. The first capacitor C1 is connected between a first driving clock signal (PCKV-L) input terminal and the reset control signal (RS) output terminal. The third and fourth switches may be embodied respectively as third and fourth thin film transistors T3 and T4. For example, the third thin film transistor T3 has a gate connected to the reset control signal (RS) output terminal, a source connected to the driving control signal (ND) input terminal (for example, the source is connected to the driving control signal (ND) output terminal of the input unit 211), and a drain connected to the ground signal (VSS) input terminal. The fourth thin film transistor T4 has a gate connected to the driving control signal (ND) input terminal, a source connected to the reset control signal (RS) output terminal, and a drain connected to the ground signal (VSS) input terminal. Thus, when a logic-high signal is applied as the driving control signal ND, the fourth thin film transistor T4 is turned on to output the logic-low ground signal VSS as the reset control signal RS. When the logic-low driving control signal ND is applied, the reset control signal (RS) output terminal is floated. When the logic-high first driving clock signal PCKV-L is applied, the reset control signal (RS) output terminal is boosted by the first capacitor C1 to output the logic-high reset control signal RS. Thus, the third thin film transistor T3 is turned on to drop the driving control signal ND to the logic-low ground signal VSS.

The first signal output unit 213 outputs the logic-high $J^{th}$ stage driving signal $P_j$ according to the driving control signal ND and the first driving clock signal PCKV-L, and increases the voltage level of the driving control signal ND. The first signal output unit 213 outputs the logic-low $J^{th}$ stage driving signal $P_j$ according to the reset control signal RS and the first driving clock bar signal PCKVB-L. The first signal output unit 213 reduces the logic level of the $J^{th}$ stage driving signal $P_j$ to the ground level according to the reset control signal RS and the first driving clock bar signal PCKVB-L.

The first signal output unit 213 includes: a fifth switch, a sixth switch, a seventh switch, and a second capacitor C2. The fifth switch is configured to output the first driving clock signal PCKV-L as the $J^{th}$ stage driving signal $P_j$ according to the driving control signal ND. The second capacitor C2 is connected between a $J^{th}$ stage driving signal ($P_j$) output terminal and the driving control signal (ND) input terminal. The sixth switch is configured to reduce the logic level of the $J^{th}$ stage driving signal $P_j$ to the ground level according to the reset control signal RS. The seventh switch is configured to reduce the logic level of the $J^{th}$ stage driving signal $P_j$ to the ground level according to the first driving clock bar signal PCKVB-L. The fifth through seventh switches may be respectively embodied as fifth through seventh thin film transistors T5 through T7. For example, the fifth thin film transistor T5 has a gate connected to the driving control signal (ND) input terminal, a source connected to the first driving clock signal (PCKV-L) input terminal, and a drain connected to the $J^{th}$ stage driving signal ($P_j$) output terminal. The sixth thin film transistor T6 has a gate connected to the reset control signal (RS) input terminal, a source connected to the $J^{th}$ stage driving signal ($P_j$) output terminal, and a drain connected to the ground signal (VSS) input terminal. The seventh thin film transistor T7 has a gate connected to a first driving clock bar signal (PCKVB-L) input terminal, a source connected to the $J^{th}$ stage driving signal ($P_j$) output terminal, and a drain connected to the ground signal (VSS) input terminal. Thus, when the logic-high driving control signal ND is applied, the fifth thin film transistor T5 is turned on and the second capacitor C2 is charged to a voltage corresponding to the logic-high driving control signal ND. Thereafter, when the first driving clock signal PCKV-L becomes logically high, the turned-on fifth thin film transistor T5 outputs the logic-high first driving clock signal PCKV-L as the $J^{th}$ stage driving signal $P_j$. When the logic level of the $J^{th}$ stage driving signal $P_j$ increases, the driving control signal ND is boosted by the second capacitor C2 to increase its voltage level. When the reset control signal RS or the first driving clock bar signal PCKVB-L becomes logically high, the sixth thin film transistor T6 or the seventh thin film transistor T7 is turned on to reduce the logic level of the $J^{th}$ stage driving signal $P_j$ to a low logic level. For example, the first signal output unit 213 uses an AND gate for performing a logical product operation on the driving control signal ND and the first driving clock signal PCKV-L, which outputs the logic-high $J^{th}$ stage driving signal $P_j$ when the driving control signal ND and the first driving clock signal PCKV-L are all logically high.

The second signal output unit 214 outputs the logic-high $J^{th}$ gate turn-on voltage signal according to the driving control signal ND and the first driving clock signal PCKV-L, and increases the voltage level of the driving control signal ND. The second signal output unit 214 outputs a ground-level gate turn-on voltage signal according to the reset control signal RS and the first driving clock bar signal PCKVB-L.

The second signal output unit 214 includes: an eighth switch, a ninth switch, a tenth switch, and a third capacitor C3. The eighth switch is configured to output the first driving clock signal PCKV-L as the $J^{th}$ gate turn-on voltage signal according to the driving control signal ND. The third capacitor C3 is connected between a $J^{th}$ gate turn-on voltage signal output terminal and the driving control signal (ND) input terminal. The ninth switch is configured to reduce the logic level of the $J^{th}$ gate turn-on voltage signal output terminal to the ground level according to the reset control signal RS. The tenth switch is configured to reduce the logic level of the $J^{th}$ gate turn-on voltage signal output terminal to the ground level according to the first driving clock bar signal PCKVB-L. The eighth through tenth switches may be respectively embodied as eight through tenth thin film transistors T8 through T10. For example, the eighth thin film transistor T8 has a gate connected to the driving control signal (ND) input terminal, a source connected to a first gate clock signal (CKV-L) input terminal, and a drain connected to the $J^{th}$ gate turn-on voltage signal output terminal. The ninth thin film transistor T9 has a gate connected to the reset control signal (RS) input terminal, a source connected to the $J^{th}$ gate turn-on voltage signal output terminal, and a drain connected to the ground signal (VSS) input terminal. The tenth thin film transistor T10 has a gate connected to the first driving clock bar signal (PCKVB-L) input terminal, a source connected to the $J^{th}$ gate turn-on voltage signal output terminal, and a drain connected to the ground signal (VSS) input terminal. Thus, when the logic-high driving control signal ND is applied, the eighth thin film transistor T8 is turned on and the third capacitor C3 is charged to a voltage corresponding to the logic-high driving control signal ND. Thereafter, when the first gate clock signal CKV-L becomes logically high, the turned-on eighth thin film transistor T8 outputs the logic-high first gate clock signal CKV-L as the $J^{th}$ gate turn-on voltage signal. When the logic level of the $J^{th}$ gate turn-on voltage signal increases, the driving control signal ND is boosted by the third capacitor C3 to increase its voltage level. When the reset control signal RS or the first driving clock bar signal PCKVB-L becomes logically high, the ninth thin film transistor T9 or the tenth thin film transistor T10 is turned on to output the ground signal VSS as a gate turn-off voltage signal. For example, the second signal output unit 214 uses an AND gate for performing a logical product operation on the driving control signal ND and the first gate clock signal CKV-L, which outputs the logic-high gate turn-on voltage signal when the driving control signal ND and the first gate clock signal CKV-L are all logically high.

The boosting voltage provider 215 provides the boosting voltage VBS to the $J^{th}$ storage line $S_j$ according to the driving control signal ND. Thus, the charge quantity of the storage capacitor Cst increases and thus the charge quantity of the pixel capacitor Clc increases. The boosting voltage provider 215 includes an eleventh switch that is connected between a boosting voltage (VBS) input terminal and a boosting voltage (VBS) output terminal according to the driving control signal ND. The eleventh switch may be embodied as an eleventh thin film transistor T11.

When the logic-high driving control signal ND and the first gate clock signal CKV-L are applied, a gate turn-on voltage is applied to the $J^{th}$ gate line $G_j$. The gate turn-on voltage is provided for a period (1H). A data signal (e.g., a gradation signal) received through a data line Dm is provided by a turned-on thin film transistor T to the pixel capacitor Clc and the storage capacitor Cst. Thereafter, when the first gate clock signal CKV-L becomes logically low, the gate turn-on voltage is no longer provided to the $J^{th}$ gate line $G_j$. The pixel capacitor Clc and the storage capacitor Cst are charged with a quantity of charge corresponding to the received data signal. Thereafter, when the boosting voltage VBS is provided to the $J^{th}$ storage line $S_j$, the charge quantity of the storage capacitor Cst changes, thereby changing the charge quantity of the pixel capacitor Clc.

Hereinafter, a description will be given of the forward operation of the stage units 210 in the first and second gate drivers 200-L and 200-R. Herein, "forward operation" denotes an operation of providing the gate turn-on voltage signal to the gate lines G1 through Gn sequentially in a top to bottom direction of the non-rotated display panel 100. Thus, the stage units 210 are also turned on sequentially in a top to bottom direction of the non-rotated display panel 100. The following description is made in terms of the $J^{th}$ stage unit 210-J.

Figure 5:
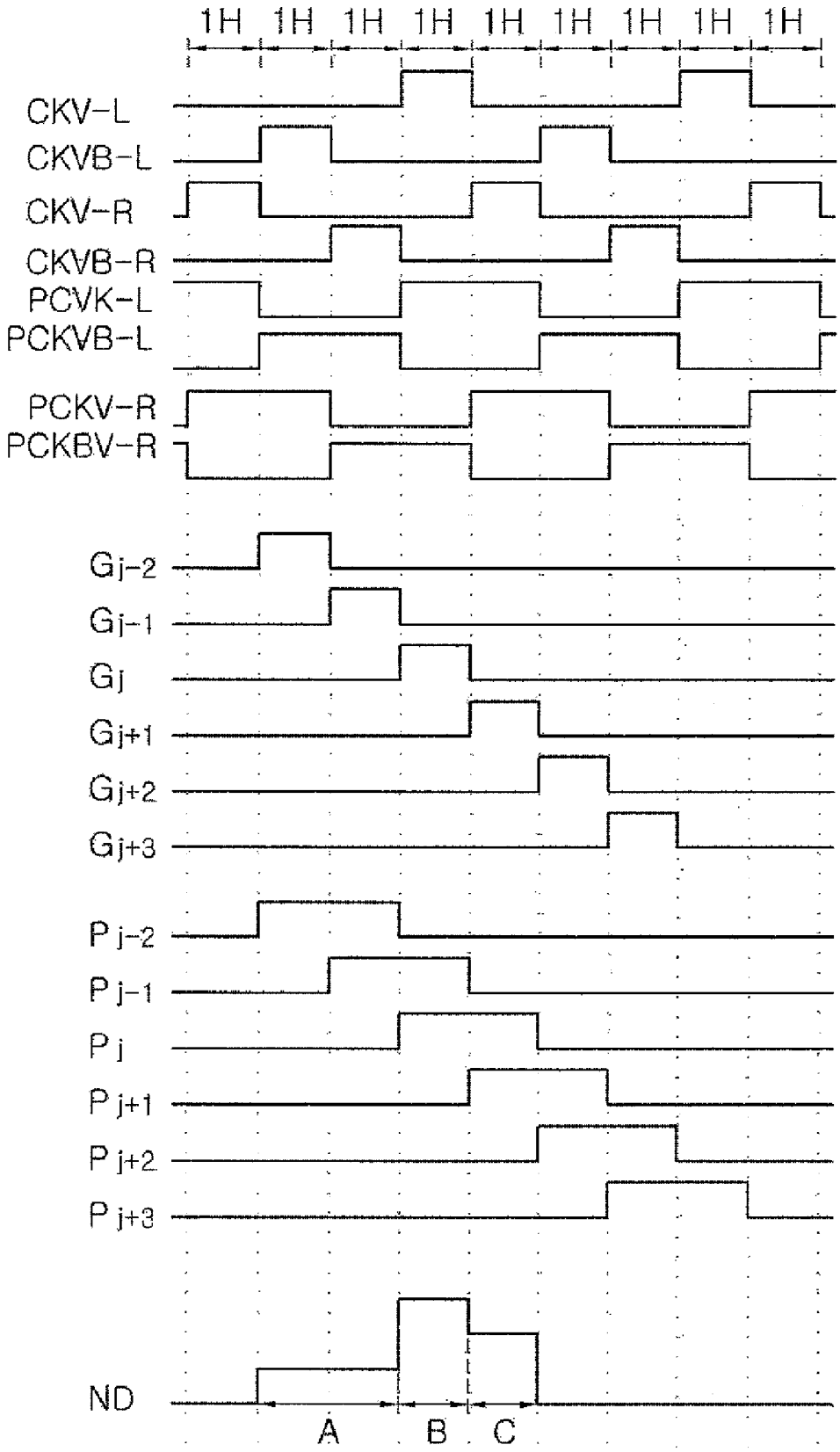
FIG. 5 is a waveform diagram illustrating a forward operation of the first and second gate drivers according to an exemplary embodiment of the present invention.

FIG. 5 is a waveform diagram illustrating a forward operation of the first and second gate drivers according to an exemplary embodiment of the present invention.

Referring to FIG. 5, the first and second driving clock signals PCKV-L and PCKV-R have a cycle of four periods (4H). The first and second driving clock signals PCKV-L and PCKV-R are a logic-high for two periods (2H) of one cycle. The first and second driving clock signals PCKV-L and PCKV-R have a phase difference of one period (1H) therebetween. That is, the second driving clock signal PCKV-R becomes logically high after one period (1H) from the time when the first driving clock signal PCKV-L becomes logically high. The first driving clock bar signal PCKVB-L may be an inverted signal of the first driving clock signal PCKV-L and the second driving clock bar signal PCKVB-R may be an inverted signal of the second driving clock signal PCKV-R. Herein, an inverted signal has inversions of the logic-high and logic-low periods of a non-inverted signal while having the same cycle as the non-inverted signal.

The first and second gate clock signals CKV-L and CKV-R and the first and second gate clock bar signals CKVB-L and CKVB-R have a cycle of four periods (4H). The first and second gate clock signals CKV-L and CKV-R and the first and second gate clock bar signals CKVB-L and CKVB-R are a logic-high for one period (1H) of one cycle. The first gate clock signal CKV-L has the same rising-edge period as the first driving clock signal PCKV-L, the first gate clock bar signal CKVB-L has the same rising-edge period as the first driving clock bar signal PCKVB-L, the second gate clock signal CKV-R has the same rising-edge period as the second driving clock signal PCKV-R, and the second gate clock bar signal CKVB-R has the same rising-edge period as the second driving clock bar signal PCKVB-R.

Through the above-described signal waveforms, the first and second gate drivers 200-L and 200-R can drive the stage units 210 sequentially, and can provide the gate turn-on voltage signal to the gate lines G1 through Gn sequentially. The waveforms of the first and second gate clock signals CKV-L and CKV-R and the first and second gate clock bar signals CKVB-L and CKVB-R may be adjusted (e.g., omission of the rising-edge periods) so that the gate turn-on voltage signal is only provided to some of the gate lines G1 through Gn.

For the forward operation of providing the gate turn-on voltage signal in the forward direction as illustrated in FIG. 5, the forward direction signal DIR has a logic-high level and the backward direction signal DIRB has a logic-low level. The input unit 211 of the $J^{th}$ stage unit 210-J receives the logic-high $(J-2)^{th}$ stage driving signal $P_{j-2}$ output from the $(J-2)^{th}$ stage unit 210-J−2 (e.g., a previous stage unit) to output the logic-high forward direction signal DIR as the logic-high driving control signal ND. Due to the driving control signal ND maintaining a logic-high state, the reset unit 212 outputs the logic-low reset control signal RS. Due to the first driving clock bar signal PCKVB-L maintaining a logic-high state, the first and second signal output units 213 and 214 respectively output the logic-low $J^{th}$ stage driving signal $P_j$ and the gate turn-off voltage signal.

Thereafter, the $(J-2)^{th}$ stage driving signal $P_{j-2}$ becomes a logic-low state after maintaining a logic-high state for two periods (2H). The driving control signal ND becomes a logic-high state while the $(J-2)^{th}$ stage driving signal $P_{j-2}$ maintains a logic-high state (see period A in FIG. 5). When the $(J-2)^{th}$ stage driving signal $P_{j-2}$ becomes a logic-low state, the driving control signal (ND) output terminal is floated to maintain the logic-high driving control signal ND. The first driving clock signal PCKV-L and the first gate clock signal CKV-L become a logic-high state. Thus, the first signal output unit 213 outputs the logic-high first driving clock signal PCKV-L as the $J^{th}$ stage driving signal $P_j$, and boosts the driving control signal ND to increase its voltage level. The second signal output unit 214 outputs the logic-high first gate clock signal CKV-L as the gate turn-on voltage signal to the $J^{th}$ gate line $G_j$, and boosts the driving control signal ND to increase its voltage level. In this way, the driving control signal ND of the floated driving control signal output terminal maintains a maximum voltage level through two boosting operations (see period B in FIG. 5). For example, if the driving control signal ND has a voltage level of 10 V and if the logic-high first driving clock signal PCKV-L and the first gate clock signal CKV-L have a voltage level of 10 V, the twice-boosted driving control signal ND has a voltage level of 30 V (=10 V+10 V+10 V).

Then, after one period (1H), the first gate clock signal CKV-L becomes a logic-low state. Thus, the second signal output unit 214 outputs the logic-low gate turn-off voltage signal to the $J^{th}$ gate line $G_j$. Therefore, at least one embodiment of the present invention can provide the gate turn-on voltage signal to the gate line for one period (1H). An inverse boosting phenomenon is generated by the second signal output unit 214. Herein, "inverse boosting" denotes a phenomenon in which the voltage level of the floated first terminal of the third capacitor C3 also decreases as the voltage level of the second terminal of the third capacitor C3 changes from a logic high to a logic low. The inverse boosting phenomenon reduces the voltage level of the driving control signal ND. However, because the first driving clock signal PCKV-L maintains a logic-high state, the boosting phenomenon of the driving control signal ND is merely reduced but is not offset. That is, the driving control signal ND maintains the once-boosted voltage level (see period C in FIG. 5). In this way, use of the driving control signal ND, can provide the boosting voltage VBS to the storage capacitor Cst of the pixel 10 after the gate turn-on voltage is applied for one period (1H). That is, the driving control signal ND continues to maintain a logic-high level in a previous or next region after the gate turn-on voltage is applied, and the boosting voltage VBS is provided to the above region, thereby increasing the charge quantity of the pixel (e.g., liquid crystal) capacitor Clc in the pixel 10. The driving control signal ND with the once-boosted voltage level is applied to the gate of the eleventh thin film transistor T11, thereby providing the boosting voltage VBS to the $J^{th}$ storage line $S_j$. The size of the eleventh thin film transistor T11 can be reduced because the driving control signal ND with the once-boosted voltage level is applied to the gate of the eleventh thin film transistor T11. As a voltage applied to a gate of a thin film transistor increases, the amount of a current flowing through a channel of the thin film transistor increases exponentially. Thus, even when the size of the eleventh thin film transistor T11 decreases, the boosting voltage VBS can be provided to the $J^{th}$ storage line $S_j$ without a voltage drop. In this way, the total size of the stage unit 210 can be reduced by reducing the size of the eleventh thin film transistor T11.

Due to the first driving clock signal PCKV-L maintaining a logic-high state for two periods (2H), the $J^{th}$ stage driving signal $P_j$ output from the first signal output unit 213 also maintains a logic-high state for two periods (2H). Thereafter, when the first driving clock signal PCKV-L becomes a logic-low state, the first driving clock bar signal PCKVB-L (i.e., an inverted signal of the first driving clock signal PCKV-L) becomes a logic-high state. Thus, both of the output signals of the first and second signal output units 213 and 214 become the logic-low or a ground level. The $(J+2)^{th}$ stage driving signal $P_{j+2}$ also becomes a logic-high state and thus the logic-low backward direction signal DIRB is provided as the driving control signal ND.

The stage units 210 of the first and second gate drivers 200-L and 200-R can perform a backward operation. Herein, "backward operation" denotes an operation of providing the gate turn-on voltage signal to the gate lines G1 through Gn sequentially in a bottom to top direction of the display panel 100. Thus, in a backward operation mode, the stage units 210 are turned on sequentially in the bottom to top direction of the display panel 100. Herein, the backward operation is performed when the display panel 100 is rotated by 180°. That is, the backward operation is performed after inversion of the top and bottom of the display panel 100, and the gate turn-on voltage is provided to the gate lines sequentially in the top to bottom direction of the inverted display panel (e.g., in the bottom to top direction of the non-inverted display panel).

Figure 6:
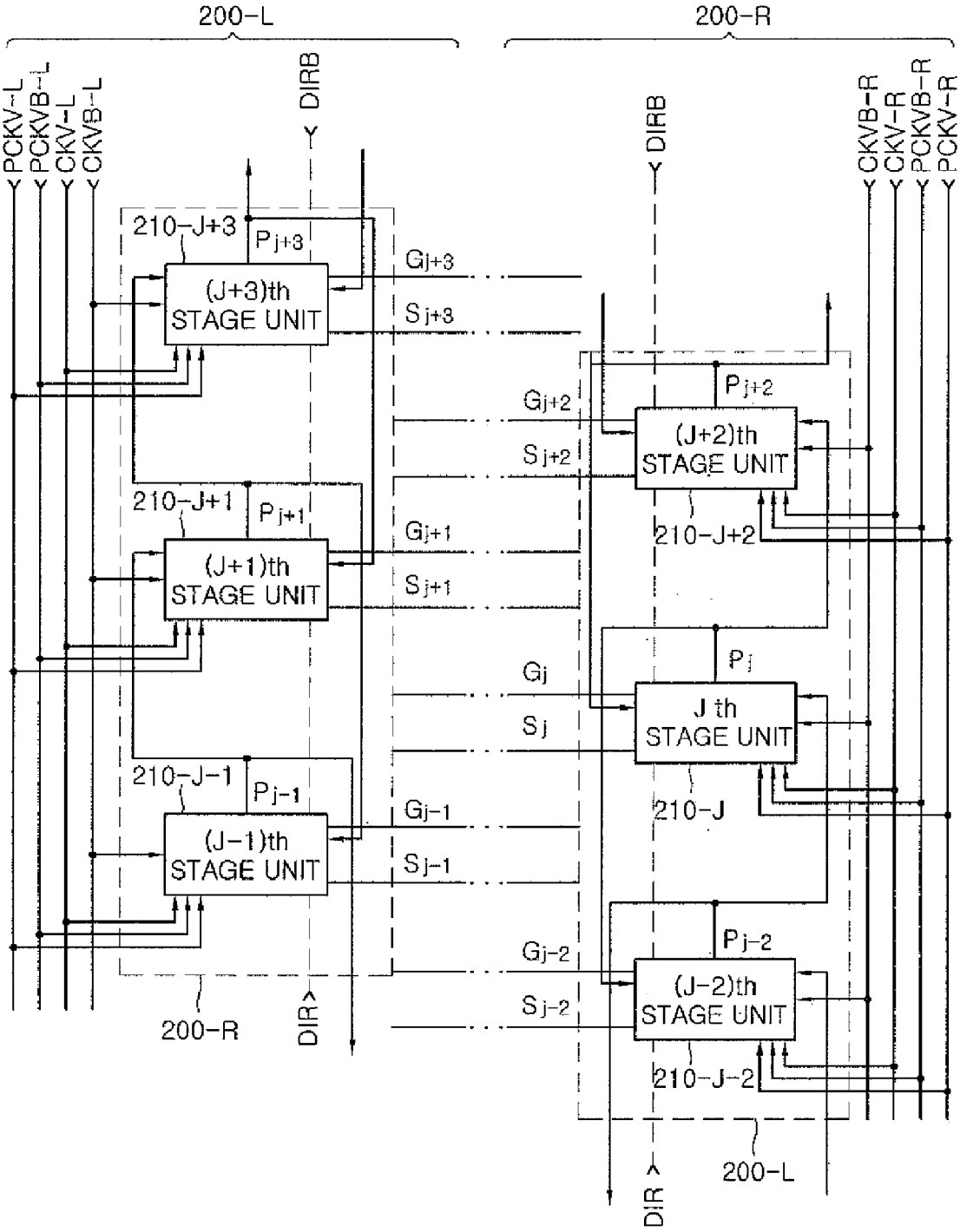
FIG. 6 is a block diagram of the first and second gate drivers rotated by 180° in accordance with an exemplary embodiment.
Figure 7:
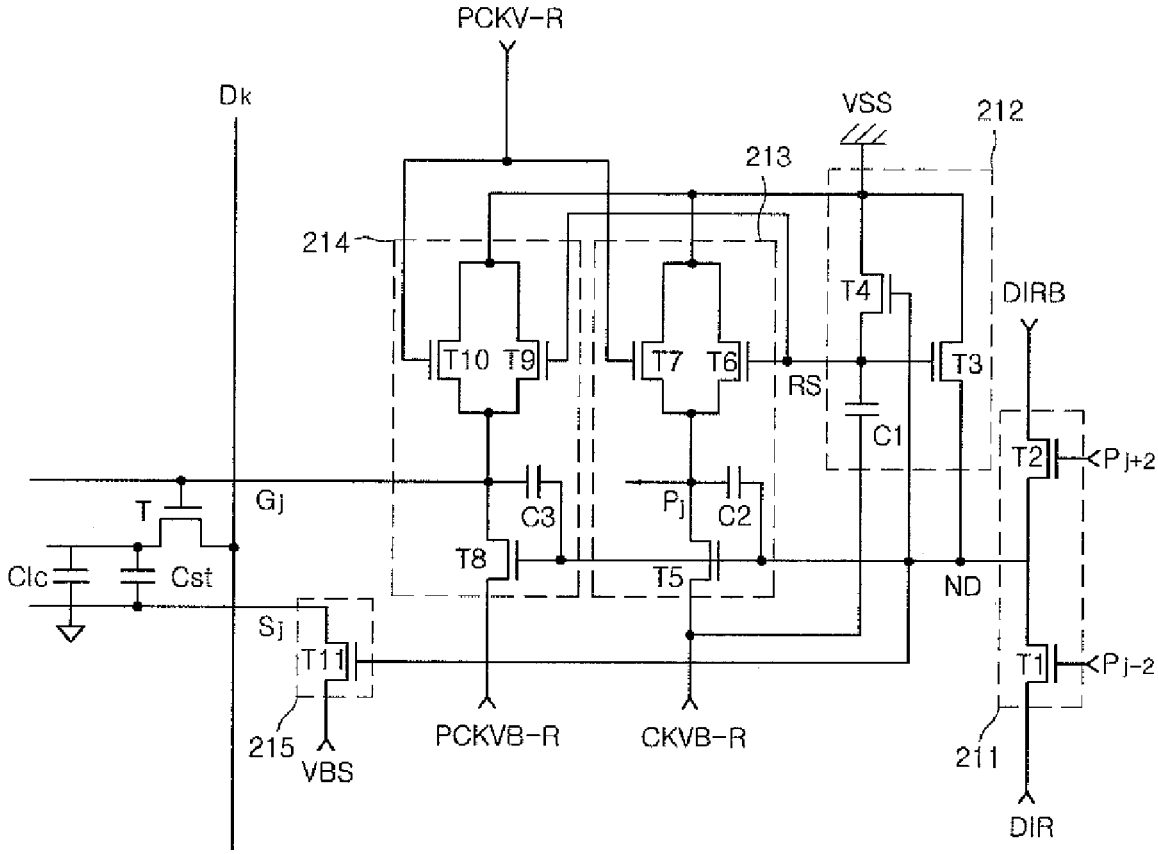
FIG. 7 is a circuit diagram of the stage unit rotated by 180° according to an exemplary embodiment of the present invention.
Figure 8:
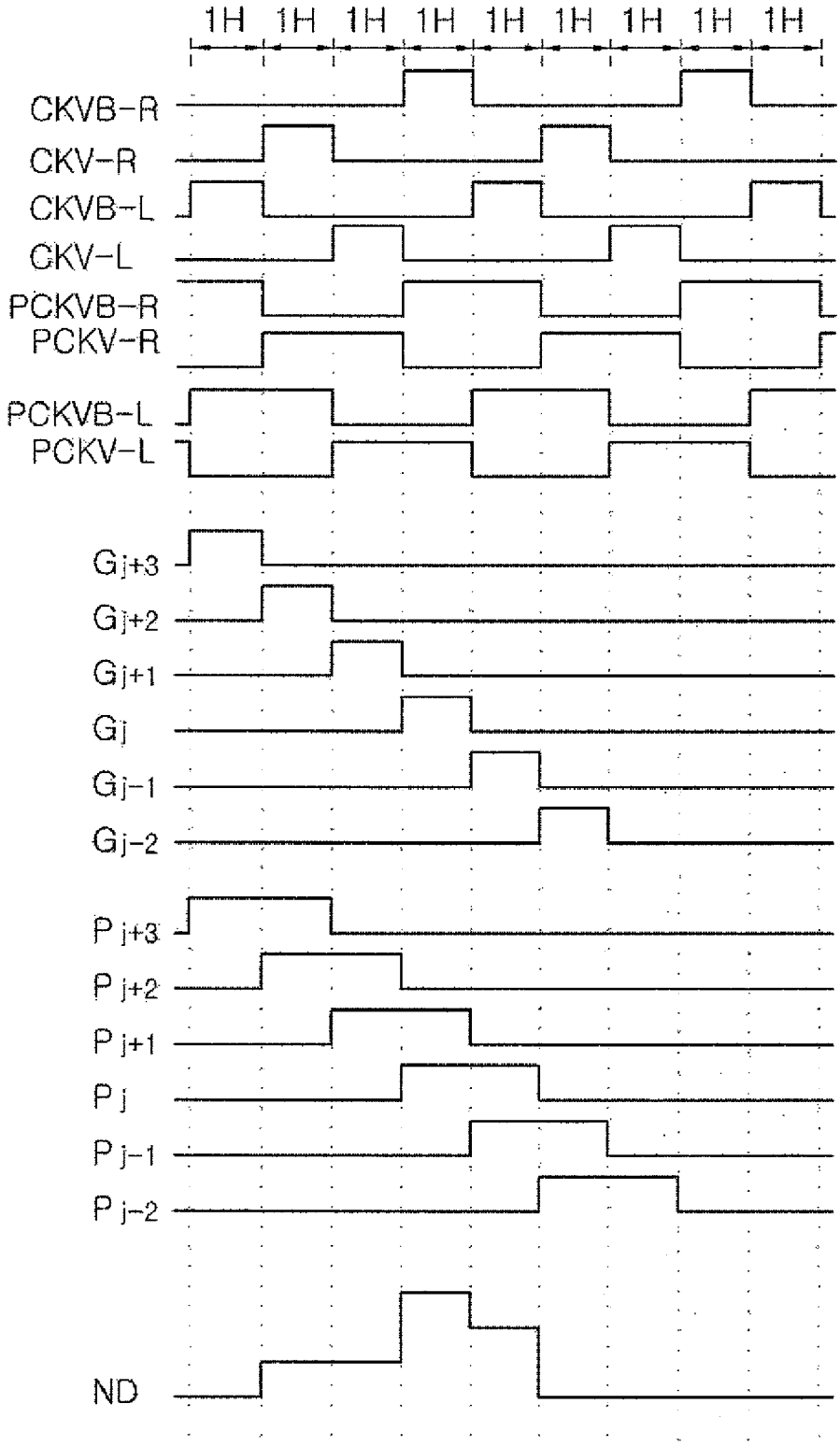
FIG. 8 is a waveform diagram illustrating a backward operation of the first and second gate drivers according to an exemplary embodiment of the present invention.

FIG. 6 is a block diagram of the first and second gate drivers rotated by 180° according to an exemplary embodiment of the present invention. FIG. 7 is a circuit diagram of a stage unit rotated by 180° according to an exemplary embodiment of the present invention. FIG. 8 is a waveform diagram illustrating a backward operation of the first and second gate drivers according to an exemplary embodiment of the present invention.

Referring to FIGS. 6 through 8, when the display panel 100 is rotated by 180°, the signals provided to the respective stage units 210 are changed. Due to the rotation of the display panel 100 by 180°, the first gate driver 200-L located in the left region of the display panel 100 is disposed in the right region and the second gate driver 200-R located in the right region is disposed in the left region. Thus, the first gate driver 200-L receives the second driving clock signal PCKV-R, the second driving clock bar signal PCKVB-R, the second gate clock signal CKV-R, and the second gate clock bar signal CKVB-R. The second gate driver 200-R also receives the first driving clock signal PCKV-L, the first driving clock bar signal PCKVB-L, the first gate clock signal CKV-L, and the first gate clock bar signal CKVB-L. Due to the rotation of the display panel 100 by 180°, the second gate clock bar signal CKVB-R is provided to the line of the first gate driver 200-L, to which the first gate clock signal CKV-L was provided in the forward operation mode; the second gate clock signal CKV-R is provided to the line of the first gate driver 200-L, to which the first gate clock bar signal CKVB-L was provided in the forward operation mode; the second driving clock bar signal PCKVB-R is provided to the line of the first gate driver 200-L, to which the first driving clock signal PCKV-L was provided in the forward operation mode; and the second driving clock signal PCKV-R is provided to the line of the first gate driver 200-L, to which the first driving clock bar signal PCKVB-L was provided in the forward operation mode. Further, the first gate clock bar signal CKVB-L is provided to the line of the second gate driver 200-R, to which the second gate clock signal CKV-R was provided in the forward operation mode; the first gate clock signal CKV-L is provided to the line of the second gate driver 200-R, to which the second gate clock bar signal CKVB-R was provided in the forward operation mode; the first driving clock bar signal PCKVB-L is provided to the line of the second gate driver 200-R, to which the second driving clock signal PCKV-R was provided in the forward operation mode; and the first driving clock signal PCKV-L is provided to the line of the second gate driver 200-R, to which the second driving clock bar signal PCKVB-R was provided in the forward operation mode.

Hereinafter, the waveform diagram of FIG. 8 is referenced to describe an operation of the $J^{th}$ stage unit 210-J provided with signals that are changed by rotating the display panel 100 as described above.

Due to the rotation of the display panel 100, the forward direction signal DIR becomes a logic-low level and the backward direction signal DIRB becomes a logic-high level. The $(J+2)^{th}$ stage unit 210-J+2 is first driven and thus the $(J+2)^{th}$ stage driving signal $P_{j+2}$ first becomes a logic-high level. Thus, the input unit 211 outputs the logic-high backward direction signal DIRB as the driving control signal ND. Thereafter, when the second driving clock bar signal PCKVB-R and the second gate clock bar signal CKVB-R become a logic-high level, the first signal output unit 213 outputs the logic-high $J^{th}$ stage driving signal $P_j$ and the second signal output unit 214 provides the logic-high gate turn-on voltage signal to the $J^{th}$ gate line. The driving control signal ND is twice boosted by the first and second signal output units 213 and 214 to increase its voltage level. Then, after one period (1H), the second gate clock bar signal CKVB-R becomes a logic-low level and thus the gate turn-off voltage signal is provided to the $J^{th}$ gate line $G_j$. However, because the second driving clock bar signal PCAKVB-R maintains a logic-high level for an additional period (1H), the driving control signal ND can maintain a logic-high level. The boosting voltage can be provided to the storage capacitor Cst of the pixel 10 in the above period (e.g., the period immediately after application of the gate turn-off voltage).

A display device according to at least one embodiment of the present invention can perform a partial driving operation of changing a partial-period image of the display panel 100. For example, the gate turn-on voltage signal may only be provided to some of the gate lines.

Figure 9:
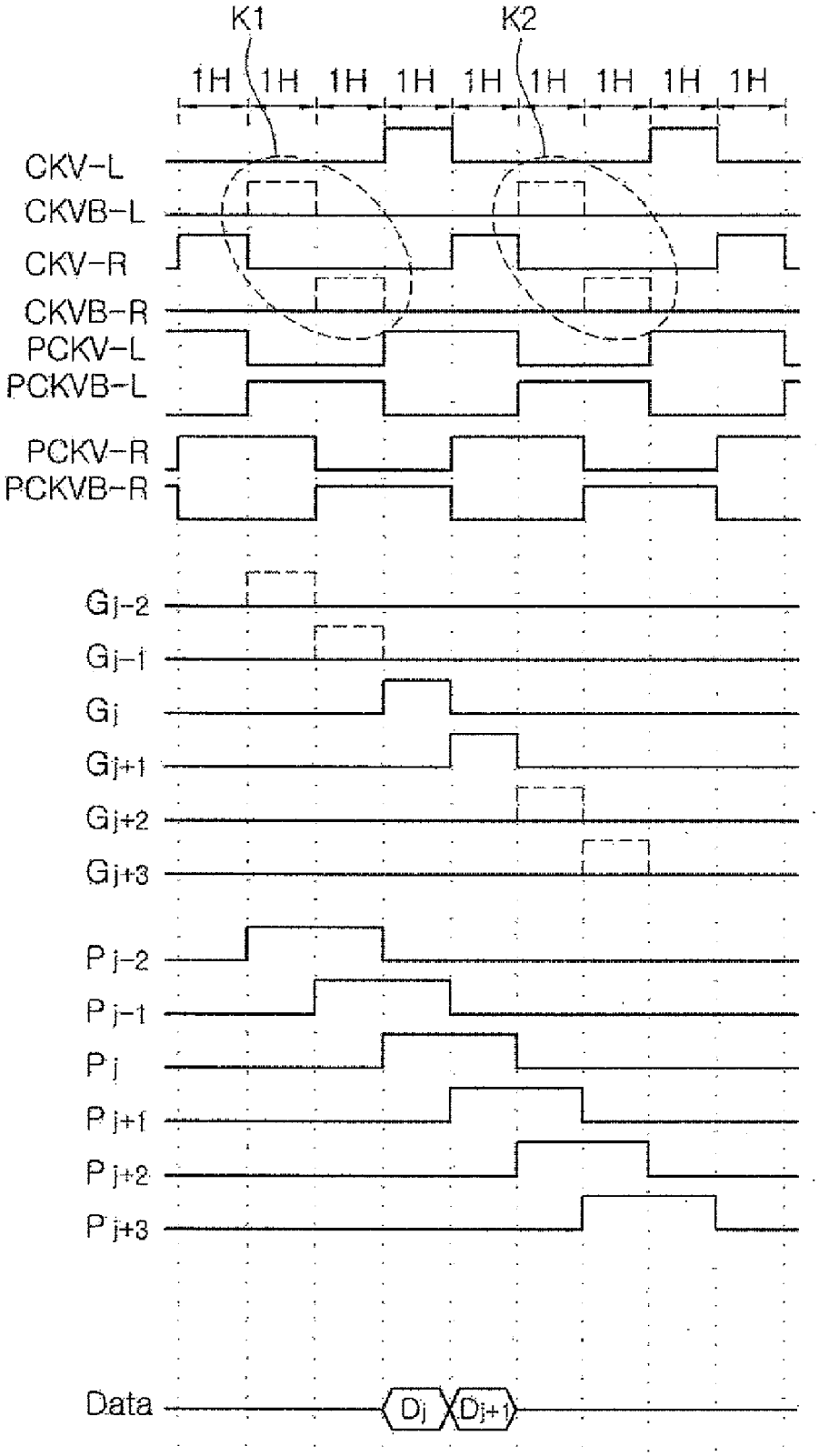
FIG. 9 is a waveform diagram illustrating a partial driving operation of the first and second gate drivers according to an exemplary embodiment of the present invention.

FIG. 9 is a waveform diagram illustrating a partial driving operation of the first and second gate drivers according to an exemplary embodiment of the present invention.

Referring to FIG. 9, a display device according to an exemplary embodiment of the present invention performs a partial driving operation by providing a gate turn-on voltage signal and a data signal (Data) only to a local region of the display panel 100 using the first and second gate clock signals CKV-L and CKV-R and the first and second gate clock bar signals CKVB-L and CKVB-R. That is, the first and second driving clock signals PCKV-L and PCKV-R and the first and second driving clock bar signals PCKVB-L and PCKVB-R repeat their logic states periodically during 1 frame (e.g., a cycle). However, the first and second gate clock signals CKV-L and CKV-R and the first and second gate clock bar signals CKVB-L and CKVB-R repeat their logic states discontinuously during 1 frame. That is, the periodic repetition occurs in a partial period of the 1 frame. Due to the logic states of the first and second driving clock signals PCKV-L and PCKV-R and the first and second driving clock bar signals PCKVB-L and PCKVB-R being periodically repeated, the first signal output units 213 of the stage units 210 are sequentially driven to output the stage driving signals sequentially. However, because the logic states of the first and second gate clock signals CKV-L and CKV-R and the first and second gate clock bar signals CKVB-L and CKVB-R are discontinuously repeated, the second signal output units 214 of the stage units 210 output the gate turn-on voltage signal only in a partial period.

Hereinafter, the waveform diagram of FIG. 9 is described on the basis of the stage units 210 illustrated in FIGS. 3 and 4. In at least one embodiment of the present invention, signals are applied so that a logic-high period does not occur for two cycles of the first and second gate clock bar signals CKVB-L and CKVB-R (see regions K1 and K2 in FIG. 9). Thus, the $(J-2)^{th}$ stage unit 210-J−2 is provided with the logic-low first gate clock bar signal CKVB-L. The second signal output unit 214 of the $(J-2)^{th}$ stage unit 210-J−2 cannot provide the logic-high gate turn-on signal to the $(J-2)^{th}$ gate line $G_{j-2}$, and outputs only the logic-low gate turn-off voltage. However, the first signal output unit 213 of the $(J-2)^{th}$ stage unit 210-J−2 normally receives the logic-high first driving clock signal PCKV-L to output the $(J-2)^{th}$ stage driving signal $P_{j-2}$ maintaining a logic-high level for two periods (2H). The $(J-1)^{th}$ stage unit 210-J−1, the $(J+2)^{th}$ stage unit 210-J+2, and $(J+3)^{th}$ stage unit 210-J+3 cannot provide the gate turn-on voltage to the $(J-1)^{th}$ gate line $G_{j-1}$, the $(J+2)^{th}$ gate line $G_{j+2}$, and the $(J+3)^{th}$ gate line $G_{j+3}$ due to the logic-low first gate clock bar signal CKVB-L and the second gate clock bar signal CKVB-R. However, because the $J^{th}$ stage unit 210-J and the $(J+1)^{th}$ stage unit 210-J+1 respectively receive the logic-high first gate clock signal CKV-L and the second gate clock signal CKV-R, they can provide the gate turn-on voltage to the $J^{th}$ gate line $G_j$ and the $(J+1)^{th}$ gate line $G_{j+1}$ sequentially for one period (1H). Data signals $D_j$ and $D_{j+1}$ are provided through the data lines during part of the gate turn-on voltage, thereby providing the corresponding data signal to the pixel capacitor Clc of the corresponding pixel 10.

Figure 10:
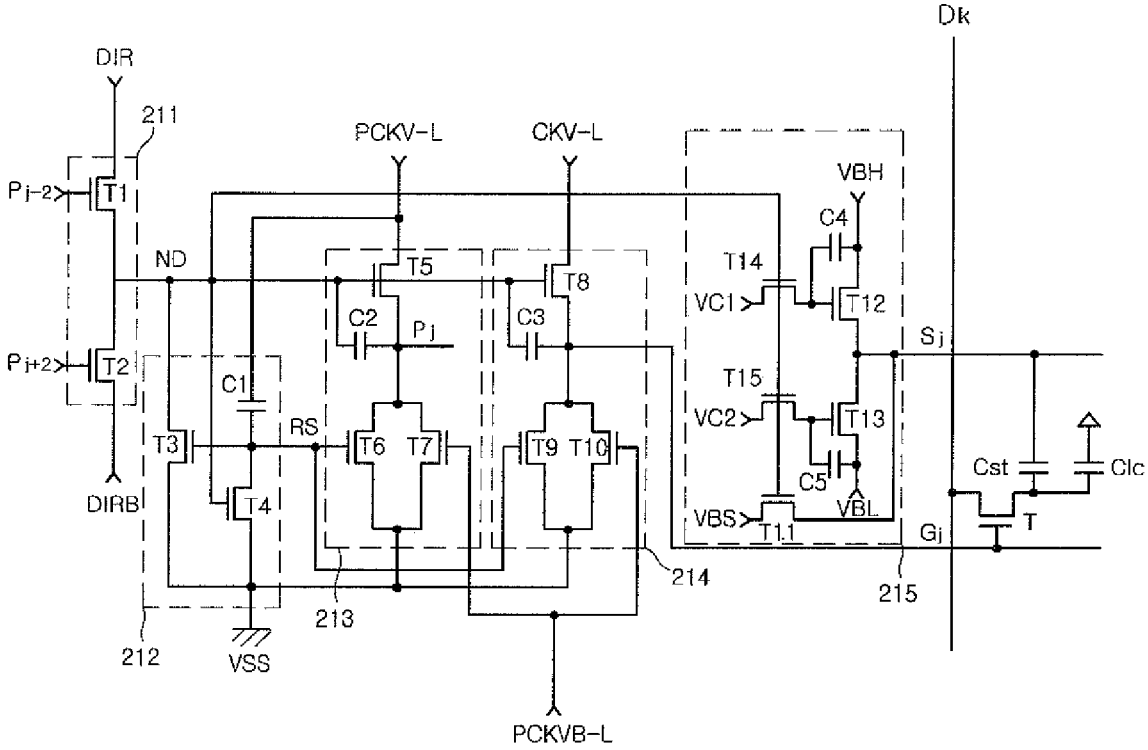
FIG. 10 is a circuit diagram of the stage unit according to an exemplary embodiment of the present invention.

FIG. 10 is a circuit diagram of a stage unit for a display device according to an exemplary embodiment of the present invention. Referring to FIG. 10, the $J^{th}$ stage unit 210-J according to an exemplary embodiment of the present invention includes an input unit 211, a reset unit 212, first and second signal output units 213 and 214, and a boosting voltage provider 215.

The boosting voltage provider 215 includes: eleventh through fifteenth thin film transistors T11-T15. The eleventh thin film transistor T11 is configured to provide the boosting voltage VBS to the $J^{th}$ storage line $S_j$ according to the driving control signal ND. The twelfth thin film transistor T12 is configured to provide a first-level common voltage VBH to the $J^{th}$ storage line $S_j$ according to a first control voltage VC1. The thirteenth thin film transistor T13 is configured to provide a second-level common voltage VBL to the $J^{th}$ storage line $S_j$ according to a second control voltage VC2. The fourteenth thin film transistor T14 is configured to provide the first control voltage VC1 to the twelfth thin film transistor T12 according to the driving control signal ND. The fifteenth thin film transistor T15 is configured to provide the second control voltage VC2 to the thirteenth thin film transistor T13 according to the driving control signal ND. The boosting voltage provider 215 further includes: fourth and fifth capacitors C4 and C5. The fourth capacitor C4 is connected between the gate of the twelfth thin film transistor T12 and a first-level common voltage (VBH) input terminal. The fifth capacitor C5 is connected between the gate of the thirteenth thin film transistor T13 and a second-level common voltage (VBL) input terminal.

When the boosting voltage VBS is not provided, the boosting voltage provider 215 can provide the first-level common voltage VBH or the second-level common voltage VBL to the $J^{th}$ storage line S. Herein, the two-level common voltages VBH and VBL are provided because the level of the common voltage varies for the inverted driving operation.

However, the display device is not limited to the above description, and can be modified in various ways. For example, the display device may further include a gate clock generator. The gate clock generator receives the first and second driving clock signals PCKV-L and PCKV-R and the first and second driving clock bar signals PCKVB-L and PCKVB-R from the signal controller 400 to generate the first and second clock signals CKV-L and CKV-R and the first and second clock bar signals CKVB-L and CKVB-R. The first and second gate drivers 200-L and 200-R may be alternately disposed on only one side of the display panel 100. For example, both drivers may be disposed on the left side or both drivers may be disposed on the right side.

The display panel 100 may be a plasma display panel (PDP), an organic light emitting diode (OLED) panel, or a liquid crystal display (LCD) panel.

As described above, each of the stage units of at least one embodiment of the present invention are driven in a forward or backward direction according to the direction signals and the stage driving signal of a previous or next stage unit. Thus, the gate turn-on voltage can be provided to the gate lines sequentially from top to bottom of the display panel even when the display panel is rotated.

According to at least one embodiment of the present invention, a stage driving signal output unit and a gate voltage signal output unit may be included in the stage unit to separate the sequential driving of the stage units from the provision of the gate voltage signal. Thus, the stage units can be driven sequentially even without applying the gate voltage signal.

According to at least one embodiment of the present invention, the driving control signal, which is used to control the operations of the stage driving signal output unit and the gate voltage signal output unit, has a longer logic-high period than the gate voltage signal. Thus, the boosting voltage can be provided to the pixel using the driving voltage signal after the logic-high gate voltage signal is applied.

According to at least one embodiment of the present invention, the voltage level of the driving control signal may be increased to reduce the size of the thin film transistor providing the boosting voltage to the pixel, thereby reducing the sizes of the stage units located on both side edges of the display panel.

Although a pixel driving circuit and a display device having the same have been described with reference to exemplary embodiments, they are not limited thereto. Therefore, it will be readily understood by those skilled in the art that various modifications and changes can be made thereto without departing from the spirit and scope of the present invention.

What is claimed is:

1. A pixel driving circuit comprising:

a first gate driver comprising a plurality of stage units connected respectively to odd-numbered gate lines of a plurality of gate lines; and a second gate driver comprising a plurality of stage units connected respectively to the even-numbered gate lines of the plurality of gate lines, each of the stage units of the first and second gate drivers comprising:

an input unit configured to output a driving control signal according to a previous stage driving signal output from the previous stage unit and a next stage driving signal output from the next stage unit;

a first signal output unit configured to output a stage driving signal according to the driving control signal and a driving clock signal; and a second signal output unit configured to output a gate voltage signal to the corresponding gate line according to the driving control signal and a gate clock signal.

2. The pixel driving circuit of claim 1, wherein the input unit comprises:

a first switch configured to connect a driving control signal output terminal and a forward direction signal input terminal receiving a forward direction signal according to a stage driving signal of the previous stage unit; and a second switch configured to connect the driving control signal output terminal and a backward direction signal input terminal receiving a backward direction signal with a logic level opposite to the logic level of the forward direction signal according to a stage driving signal of the next stage unit.

3. The pixel driving circuit of claim 1, wherein each of the stage units further comprises a reset unit configured to generate a reset control signal according to the driving control signal and the driving clock signal, wherein the driving control signal, the stage driving signal, and the gate voltage signal transition to a logic-low level according to the reset control signal.

4. The pixel driving circuit of claim 3, wherein the reset unit comprises:

a third switch configured to reduce the logic level of the driving control signal to a ground level according to the reset control signal;

a fourth switch configured to electrically connect a reset control signal output terminal and a ground signal input terminal according to the driving control signal; and a first capacitor connected between the driving clock signal input terminal and the reset control signal output terminal.

5. The pixel driving circuit of claim 3, wherein the first signal output unit outputs the stage driving signal at a high logic level when the driving control signal at a high logic level and the driving clock signal are applied, the second signal output unit outputs the gate voltage signal at a high logic level when the driving control signal at the high logic level and the gate clock signal are applied, a logic-high period of the driving clock signal is repeated periodically for a 1-frame period, and a logic-high period of the gate clock signal is repeated periodically for at least a part of the 1-frame period.

6. The pixel driving circuit of claim 5, wherein the first signal output unit comprises:

a fifth switch configured to output the driving clock signal as the stage driving signal according to the driving control signal;

a second capacitor connected between a stage driving signal output terminal and a driving control signal input terminal;

a sixth switch configured to output the ground level as the stage driving signal according to the reset control signal; and a seventh switch configured to output the ground level as the stage driving signal according to the driving clock signal.

7. The pixel driving circuit of claim 5, wherein the second signal output unit comprises:

an eighth switch configured to output the gate clock signal as the gate voltage signal according to the driving control signal;

a third capacitor connected between a gate voltage signal output terminal and a driving control signal input terminal;

a ninth switch configured to output the ground level as the gate voltage signal according to the reset control signal; and a tenth switch configured to output the ground level as the gate voltage signal according to the driving clock signal.

8. The pixel driving circuit of claim 1, wherein the gate lines are connected to a plurality of pixels, and each of the stage units further comprises a boosting voltage provider configured to provide a boosting voltage to the pixels connected to the corresponding gate line according to the driving control signal after gate voltage signal is provided to the corresponding gate line at a logic high level.

9. The pixel driving circuit of claim 8, wherein the boosting voltage provider comprises:

an eleventh switch configured to provide the boosting voltage to a pixel of the plurality according to the driving control signal;

a twelfth switch configured to provide a first-level common voltage to the pixel according to a first control voltage;

a thirteenth switch configured to provide a second-level common voltage to the pixel according to a second control voltage;

a fourteenth switch configured to provide the first control voltage to the twelfth switch according to the driving control signal; and a fifteenth switch configured to provide the second control voltage to the thirteenth switch according to the driving control signal.

10. The pixel driving circuit of claim 1, wherein the driving clock signal comprises:

a first driving clock signal and a first driving clock bar signal that are provided to the stage units in one of the first and second gate drivers; and a second driving clock signal and a second driving clock bar signal that are provided to the stage units in the other of the first and second gate drivers.

11. The pixel driving circuit of claim 10, wherein the first and second driving clock signals have a cycle of four periods (4H), the first and second driving clock signals have a logic-high for two periods (2H) of one cycle, the first and second driving clock signals have a phase difference of one period (1H) therebetween, the first driving clock bar signal is an inverted signal of the first driving clock signal, and the second driving clock bar signal is an inverted signal of the second driving clock signal.

12. The pixel driving circuit of claim 11, wherein the gate clock signal comprises:

a first gate clock signal and a first gate clock bar signal that are alternately provided to the stage units in one of the first and second gate drivers; and a second gate clock signal and a second gate clock bar signal that are alternately provided to the stage units in the other of the first and second gate drivers.

13. The pixel driving circuit of claim 12, wherein the first gate clock signal, the first gate clock bar signal, the second gate clock signal, and the second gate clock bar signal have a cycle of four periods (4H), the first gate clock signal, the first gate clock bar signal, the second gate clock signal, and the second gate clock bar signal have a logic-high for one period (1H) of one cycle, the first gate clock signal has the same rising-edge period as the first driving clock signal, the first gate clock bar signal has the same rising-edge period as the first driving clock bar signal, the second gate clock signal has the same rising-edge period as the second driving clock signal, and the second gate clock bar signal has the same rising-edge period as the second driving clock bar signal.

14. A display device comprising:

a display panel comprising a plurality of gate lines and a plurality of pixels connected to the gate lines;

a signal controller configured to provide a driving clock signal and a gate clock signal;

a first gate driver comprising a plurality of odd stage units connected to the odd-numbered gate lines, each of the odd stage units being configured to provide an odd stage driving signal to the previous/next stage unit according to the driving clock signal and a previous/next odd stage driving signal output from the previous/next stage unit and to provide a gate voltage signal to the corresponding odd-numbered gate line according to the gate clock signal and the previous/next odd stage driving signal; and a second gate driver comprising a plurality of even stage units connected to the even-numbered gate lines, each of the even stage units being configured to provide an even stage driving signal to the previous/next stage unit according to the driving clock signal and a previous/next even stage driving signal output from the previous/next stage unit and to provide a gate voltage signal to the corresponding even-numbered gate line according to the gate clock signal and the previous/next even stage driving signal.

15. The display device of claim 14, wherein each of the odd stage units and the even stage units comprises:

an input unit configured to output a driving control signal according to an output signal of the previous/next stage unit;

a first signal output unit configured to output the odd or even stage driving signal according to the driving control signal and the driving clock signal; and a second signal output unit configured to output the gate voltage signal to the corresponding gate line according to the driving control signal and the gate clock signal.

16. The display device of claim 15, wherein the first signal output unit performs one of a forward sequential driving operation and a backward sequential driving operation for a 1-frame period according to the order of the gate line connected to the stage unit, and the second signal output unit performs one of a forward sequential driving operation and a backward sequential driving operation for at least a part of the 1-frame period according to the order of the gate line connected to the stage unit.

17. The display device of claim 15, wherein each pixel comprises a pixel capacitor and a storage capacitor configured to maintain a charge quantity of the pixel capacitor, and each of the stage units further comprises a boosting voltage provider configured to provide a boosting voltage to the storage capacitor according to the voltage level of the driving control signal.

18. The display device of claim 14, wherein the driving clock signal comprises a first driving clock signal and a first driving clock bar signal that are provided to the odd stage units and a second driving clock signal and a second driving clock bar signal that are provided to the even stage units, the first and second driving clock signal have a cycle of four periods (4H), the first and second driving clock signals have a logic-high for two periods (2H) of one cycle, the first and second driving clock signals have a phase difference of one period (1H) therebetween, the first driving clock bar signal is an inverted signal of the first driving clock signal, and the second driving clock bar signal is an inverted signal of the second driving clock signal.

19. The display device of claim 18, wherein the gate clock signal comprises a first gate clock signal and a first gate clock bar signal that are alternately provided to the odd stage units and a second gate clock signal and a second gate clock bar signal that are alternately provided to the even stage units, the first gate clock signal, the first gate clock bar signal, the second gate clock signal, and the second gate clock bar signal have a cycle of four periods (4H), the first gate clock signal, the first gate clock bar signal, the second gate clock signal, and the second gate clock bar signal have a logic-high for one period (1H) for one cycle, the first gate clock signal has the same rising-edge period as the first driving clock signal, the first gate clock bar signal has the same rising-edge period as the first driving clock bar signal, the second gate clock signal has the same rising-edge period as the second driving clock signal, and the second gate clock bar signal has the same rising-edge period as the second driving clock bar signal.

20. The display device of claim 14, wherein the display panel further comprises a display region provided with the pixels and a peripheral region provided around the display region, and the first and second gate drivers are disposed on both side edges of the peripheral region.

21. A pixel driving circuit comprising:

an input unit configured to output a driving control signal according to a $(Pn-2)^{th}$ stage driving signal output from the $(Pn-2)^{th}$ previous stage unit and a $(Pn+2)^{th}$ stage driving signal output from the $(Pn+2)^{th}$ stage unit;

a first signal output unit configured to output a stage driving signal according to the driving control signal and a driving clock signal; and a second signal output unit configured to output a gate voltage signal to the corresponding gate line according to the driving control signal and a gate clock signal.

22. The pixel driving circuit of claim 21, wherein the gate line is connected to at least one of a plurality of pixels, and the pixel driving circuit further comprises a boosting voltage provider configured to provide a boosting voltage to the pixels connected to the corresponding gate line according to the driving control signal after the gate voltage signal of a high logic level is provided to the corresponding gate line.

23. A method of driving a pixel driving circuit, the method comprising:

generating a logic-high driving control signal according to one of a $(Pn-2)^{th}$ stage driving signal and a $(Pn+2)^{th}$ stage driving signal;

applying a logic-high driving clock signal to generate a logic-high stage driving signal and to increase the voltage level of the driving control signal;

applying a logic-high gate clock signal to apply a logic-high gate voltage signal to a corresponding gate line and to increase the voltage level of the driving control signal;

applying a logic-low gate clock signal to apply a logic-low gate voltage signal to the corresponding gate line and to reduce the voltage level of the driving control signal;

applying a logic-low driving clock signal to generate a logic-low stage driving signal and to reduce the voltage level of the driving control signal; and generating a logic-low driving control signal according to the other of the $(Pn-2)^{th}$ stage driving signal and the $(Pn+2)^{th}$ stage driving signal.

24. The method of claim 23, further comprising providing a boosting voltage to a plurality of pixels connected to the gate line after the applying of the logic-low gate voltage signal to the corresponding gate line.

25. The method of claim 23, wherein the driving control signal maintains a logic-high level for four periods (4H), the logic-high gate voltage signal is applied to the corresponding gate line for at least one of three periods (3H) of the four periods (4H), except the last period of the four periods (4H), and the boosting voltage is provided for the last period.

* * * * *